United States Patent [19]

Poteet

[11] Patent Number: 4,800,372

[45] Date of Patent: Jan. 24, 1989

[54] FLOOD ALARM

[76] Inventor: John H. Poteet, 303 Railroad Avenue, Bay St. Louis, Miss. 39520

[21] Appl. No.: 930,883

[22] Filed: Nov. 17, 1986

[51] Int. Cl.[4] ..... G08B 21/00

[52] U.S. Cl. ..... 340/625; 116/110; 116/229; 200/61.2; 200/84 R

[58] Field of Search ..... 340/623, 625, 569; 116/110, 227, 228, 229; 137/393, 398; 200/61.2, 84 A, 84 B, 84 R; 222/490 R, 49 X, 670 R, 67 X; 384/12; 24/522; 16/360

[56] References Cited

U.S. PATENT DOCUMENTS

| | | | |
|---|---|---|---|
| 892,425 | 7/1908 | Horner | 340/625 |
| 1,969,784 | 8/1934 | Ebright | 116/228 |
| 2,816,973 | 4/1954 | Beck | 340/625 |
| 3,309,687 | 3/1967 | Phipps | 340/625 |
| 3,611,333 | 10/1971 | Conigliaro | 340/569 |

*Primary Examiner*—Joseph A. Orsino
*Assistant Examiner*—Jill D. Jackson
*Attorney, Agent, or Firm*—Leon Gilden

[57] ABSTRACT

A mercury activated float switch is selectively positioned within a slot formed along an axial length of a perforated pipe. The pipe is vertically mounted to a weighted base, and the switch may be slid along the slot to adjust its operable height. The float member is pivotally mounted within the pipe and closes the associated switch when a preselected water level is detected. The closed switch then activates at least one type of alarm, such as an alarm bell or light, and may also be utilized to activate a transmitter which sends a signal to remotely positioned receiver.

3 Claims, 2 Drawing Sheets

FLOOD ALARM

BACKGROUND OF THE INVENTION

1. Field of the Invention

The present invention relates to flood alarms, and more particularly pertains to a flood alarm assembly which includes the use of a remotely positioned float switch.

2. Description of the Prior Art

The use of float switch activated alarm systems is well known in the prior art. Typically, these switch systems detect a rising level of water, or some other liquid, and sound an alarm to alert others of the rising liquid condition. The prior art is replete with patents directed to such float switch alarm systems. For example, U.S. Pat. No. 892,425, which issued to W. Horner on July 7, 1908, discloses an early water level indicator that makes use of a float switch. The Horner device includes a float pivotally mounted within a liquid holding container. When the liquid level reaches a prescribed height within the container, the float will close a switch, thereby to close an electrical circuit which activates an alarm bell. The Horner water level indicator is primarily designed to be utilized in a tank which normally experiences rising liquid levels.

U.S. Pat. No. 2,041,549, which issued to A. Jaeger on May 19, 1936, discloses an alarm device which is primarily intended for use in a bathtub. The device includes an adjustably positionable float member that is pivotally interconnected with a normally open switch. In response to a rising of the water level within the bathtub, the float member pivots upwardly to eventually close the associated switch, thereby to close an electrical circuit which then rings an alarm bell.

Similarly, U.S. Pat. No. 3,309,687, which issued to J. Phipps on Mar. 14, 1967, discloses a liquid level sensing device which is primarily designed to sense the water level in a boat with the device producing a warning signal when the water level reaches a preselected height. In this respect, a switch is closed in response to an upward pivoting of the float, thereby to activate a battery powered alarm bell.

As can be appreciated, the above-discussed prior art float actuated alarm systems each utilize electrical circuits that are closed in response to a pivotal movement of a float switch. The novelty shown in each of these prior art patents is directed to the specific use environment in which the system is employed, as well as to minor structural differences which particularly adapt each individual system to such a specific use. As is also apparent, each of these alarm systems are designed for attachment to a static structure and would not be particularly useful under a detached use condition. Unfortunately, none of these prior art alarm systems would be particularly useful to alert a user of a serious flood condition—especially when such flooding occurs at a location remote from his residence. More specifically, people living in low lying areas often experience unexpected flooding of their homes and grounds, and it would be particularly desirable to design a float actuated alarm system which would provide an alert in response to an external rising water condition. Such an alarm system could allow users sufficient time to remove furniture and other valuables from their homes, as well as to move their vehicles before serious water damage occurs. The present invention directly addresses this continuing serious need.

SUMMARY OF THE INVENTION

In view of the foregoing disadvantages inherent in the known types of float actuated alarm systems now present in the prior art, the present invention provides an improved float actuated alarm system which allows the remote selective positioning of the float switch, as desired, in various locations. As such, the general purpose of the present invention, which will be described subsequently in greater detail, is to provide a new and improved float actuated alarm system which has all the advantages of the prior art float actuated alarm systems and none of the disadvantages.

To attain this, the present invention comprises a normally open float switch pivotally mounted in an interior portion of a vertically mounted plastic conduit. The plastic conduit is attached in an upstanding position to a weighted base, while the float switch is slidably moveable along a slot which extends through an axial length of the conduit. As such, adjustable positioning of the switch and its pivotally mounted float is possible within the conduit. The conduit may be further provided with a plurality of through-extending apertures to facilitate water flow into and out of its interior chamber.

The conduit and its associated float switch may be positioned in a low lying area remote from a residence, if desired, and in response to a sensed water level, the float will move upwardly to close the switch associated therewith. In response to the closed switch condition, battery power is delivered to at least one of a remotely positioned alarm bell or a directly attached transmitter. In the preferred embodiment, the alarm bell would be wired directly to the float switch, while the transmitter would send a signal to an electrically powered remotely positioned receiver, thereby to provide a user with an alert regarding the rising water situation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved float actuated alarm system which has all the advantages of the prior art float actuated alarm systems and none of the disadvantages.

It is another object of the present invention to provide a new and improved float actuated alarm system which may be easily and efficiently manufactured and marketed.

It is a further object of the present invention to provide a new and improved float actuated alarm system which is of a durable and reliable construction.

An even further object of the present invention is to provide a new and improved float actuated alarm system which is susceptible of a low cost of manufacture with regard to both materials and labor, and which accordingly is then susceptible of low prices of sale to the consuming public, thereby making such float actuated alarm systems economically available to the buying public.

Still yet another object of the present invention is to provide a new and improved float actuated alarm system which provides in the apparatuses and methods of the prior art some of the advantages thereof, while simultaneously overcoming some of the disadvantages normally associated therewith.

Still another object of the present invention is to provide a new and improved float actuated switch which may be remotely selectively positioned relative to the location of an associated alarm.

Yet another object of the present invention is to provide a new and improved float actuated alarm system which is particularly adapted for detecting serious flood conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
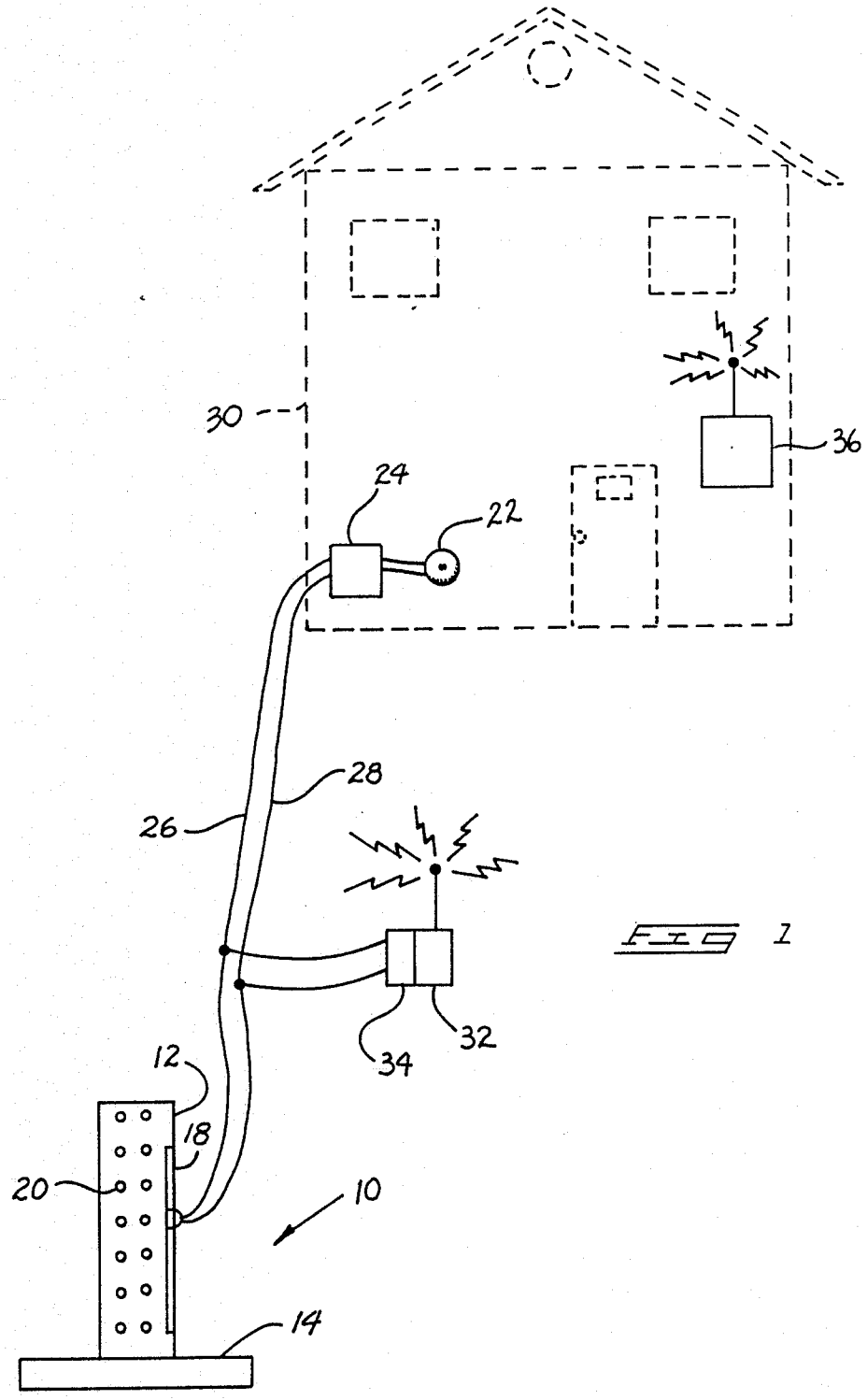
FIG. 1 is a schematic representation of the float actuated alarm system comprising the present invention.
Figure 2:
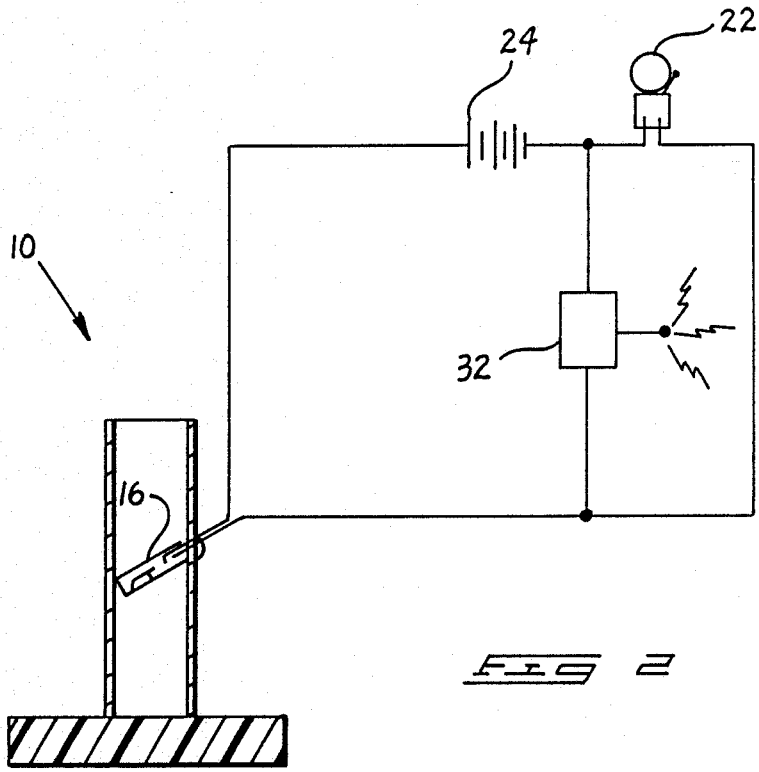
FIG. 2 is a cross-sectional view of the float actuated switch assembly forming a part of the invention.

With reference now to the drawings, and in particular to FIGS. 1 and 2 thereof, a new and improved float actuated alarm system embodying the principles and concepts of the present invention and generally designated by the reference numeral 10 will be described.

More specifically, it will be noted that the complete alarm system 10 may include a section of plastic conduit 12 vertically fixedly secured to a weighted base 14 with a float switch 16 being mounted interiorly thereof. In this regard, the plastic pipe 12 may include an axially directed through-extending slot 18 with the float switch 16 being slidably attached within the slot. Typically, the float swtich 16 would be frictionally engaged within the slot 18 so that it could be manually moved upwardly or downwardly in the slot to adjust its height of operation.

Figure 3:
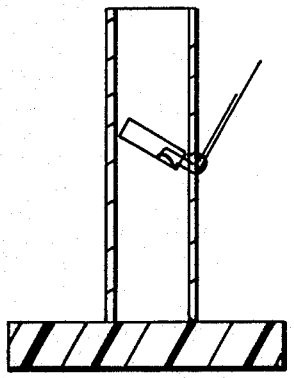
FIG. 3 is a cross-sectional view of the float switch showing the same in a closed position.

The float switch 16 would preferably be a mercury switch and would be pivotally mounted so as to pivot upwardly and downwardly in response to a sensed liquid level. In this respect, FIG. 2 of the drawings shows the switch 16 pivoted downwardly in an open position, while FIG. 3 of the drawings illustrates the switch in an upward closed position, with this upward position being attained by a rising level of liquid within the pipe. To facilitate the flow of liquid into the pipe 12, in addition to the slot 18, the pipe may be provided with a plurality of through-extending apertures 20, thereby to facilitate rapid inflow and outflow of liquid from the interior chamber of the pipe.

With further reference to the drawings, it will be noted that when the float switch 16 is in a closed position, a closed circuit is established between an alarm bell 22 and its associated battery pack 24. As illustrated, this particular alarm system requires the use of a pair of electrical leads 26, 28 which extend between the battery pack 24 and the float switch 16. Where the float switch 16 is positioned at a location substantially remote from the selected alarm location, such as a residence 30, it may be desirable to use a transmitter-receiver alarm system. In this regard, FIG. 1 illustrates a transmitter 32 having an attached battery pack 34, with the transmitter being activated in response to a closing of the float switch 16. A remotely located receiver 36 receives the alarm signal from the transmitter 32 so as to perform the same function as the aforementioned alarm bell 22.

While FIG. 1 of the drawings illustrates the transmitter 32 as having its own battery pack 34, FIG. 2 of the drawings illustrates the transmitter 32 operably attached to the battery pack 24 which powers the alarm bell 22. As such, FIG. 2 illustrates a dual alarm configuration which could be used in conjunction with the float switch 16.

With respect to the manner of usage and operation of the present invention, it can be appreciated that the float switch 16, when operably mounted within the conduit 12, may be positioned wherever desired in a low lying area remote from a residence 30. A selected water height may be chosen by a slidable movement of the switch 16 upwardly or downwardly within the slot 18, and when such a water level is detected, either the alarm bell 22 or the receiver 36, or both, will provide an appropriate alarm, thereby to permit the users to vacate the property prior to serious flood damage.

With respect to the above description then, it is to be realized that the optimum dimensional relationships for the parts if the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A float actuated alarm system, comprising:

a. float switch support means comprising a conduit vertically attached to a weighted base structure, said conduit including a through-extending axially aligned slot, said conduit further including a plurality of through-extending apertures, said slot and said apertures allowing a flow of water in and out of said conduit;

b. float switch means slidably mounted in said slot so as to permit heightwise adjustment of said float switch means, thereby to detect preselected liquid levels; and, c. alarm means operably activated by said float switch means, said alarm means including a battery powered alarm bell.

2. A float actuated alarm system, comprising:

a. float switch support means comprising a conduit vertically attached to a weighted base structure, said conduit including a through-extending axially aligned slot, said conduit further including a plurality of through-extending apertures, said slot and said apertures allowing a flow of water in and out of said conduit;

b. float switch means slidably mounted in said slot so as to permit heightwise adjustment of said float switch means, thereby to detect preselected liquid levels; and, c. alarm means operably activated by said float switch means, said alarm means including a transmitter and receiver system.

3. The float actuated alarm system of claim 1, wherein said alarm means further includes a transmitter and receiver system.

* * * * *